United States Patent [19]

Boulanger

[11] 4,349,806

[45] Sep. 14, 1982

[54] SNAP-ACTING THERMOSTATIC SWITCH USING INFLEXIBLE, SPRING BIASED CONTACT ARM

[75] Inventor: Henry J. Boulanger, Cumberland, R.I.

[73] Assignee: Texas Instruments Incorporated, Dallas, Tex.

[21] Appl. No.: 203,790

[22] Filed: Nov. 3, 1980

[51] Int. Cl.[3] ..... H01H 37/54

[52] U.S. Cl. ..... 337/343; 200/290; 337/354; 337/381

[58] Field of Search ..... 29/622; 337/53–57, 337/343–348, 354; 200/284, 290; 337/381

[56] References Cited

U.S. PATENT DOCUMENTS

| | | | |
|---|---|---|---|
| 1,362,379 | 12/1920 | Whittingham | 200/290 |
| 2,695,939 | 11/1954 | Filiette | 200/290 |
| 3,164,701 | 1/1965 | Kirchhubel | 337/346 |
| 3,259,721 | 7/1966 | Morris | 337/354 |
| 3,818,410 | 6/1974 | Hire | 337/354 |
| 3,870,985 | 3/1975 | Hire | 337/381 |
| 4,282,505 | 8/1981 | Place | 337/381 |
| 4,317,098 | 2/1982 | Colavecchio | 337/343 |

FOREIGN PATENT DOCUMENTS

| | | | |
|---|---|---|---|
| 2736172 | 2/1979 | Fed. Rep. of Germany | 200/290 |

*Primary Examiner*—William H. Beha, Jr.

*Attorney, Agent, or Firm*—John A. Haug; James P. McAndrews; Melvin Sharp

[57] ABSTRACT

A heat responsive electrical switch comprises a small, open ended, generally cylindrical housing in which are mounted two spaced plate members extending in parallel directions from a bottom wall into a switch cavity. The first plate member mounts at its distal free end a relatively inflexible movable contact arm which is adapted to move into and out of engagement with a stationary contact mounted on the second plate member. A relatively low spring rate spring is connected between the movable contact arm toward the stationary contact with a selected contact force created by displacing a portion of the spring with a reaction force. The open end of the housing is formed with a plurality of raised plateaus. A thermally conductive cup is received over the open end interfitting with the plateaus. A thermally responsive snap-acting disc and a flexible motion transfer sheet of resinous material can be captured by the cup at the open end of the housing. The plate members are formed so that they are either rigidly staked to the bottom wall of the housing or are riveted directly to terminal blades outside the housing.

26 Claims, 29 Drawing Figures

SNAP-ACTING THERMOSTATIC SWITCH USING INFLEXIBLE, SPRING BIASED CONTACT ARM

TECHNICAL FIELD

This invention relates generally to thermostatic switches and methods of making and more specifically to a small, mass producible switch in which gauging and calibration is obviated.

BACKGROUND ART

A typical prior art switch is shown and disclosed in U.S. Pat. No. 3,164,701 assigned to the assignee of the instant invention. In that patent a switch is shown which comprises a housing in which a switch cavity is formed. A stationary contact and a flexible, cantilever mounted movable contact arm are mounted in the switch cavity. An opening is formed in the housing which is closed by a thermally conductive cap trapping a snap-acting, thermally responsive disc between the cap and the housing. A motion transfer pin is slidably disposed in the housing extending between the movable contact arm and the disc so that when the disc snaps from one configuration to another, its motion is transferred to the movable contact arm to open or close the electrical connection between the stationary contact and the movable contact arm.

Switches of this type have been very effective and many hundreds of thousands have been made and sold throughout the world, however, such switches have certain limitations in today's market place. For example, calibration of the switch is required including positioning of the stationary terminal by bending the support on which the stationary contact is mounted and bending of a separate member overlying the movable contact arm in order to obtain a desired contact force. Such calibration not only requires extra parts such as calibration screws, but also adds significantly to the cost of assembly. Further, such switches are designed to carry appreciable current, in the order of 10 to 15 amps, for example, thus serving to limit the design of the movable arm. In order to conduct the required current as well as to provide suitable contact force of typically one or two ounces in the small available space, a relatively high spring rate has been required for the movable contact arm, for example, in excess of ten pounds per inch.

It is an object of the present invention to provide a thermally responsive electrical switch which is easily produced and assembled, one which requires no calibration or gauging yet has conventional contact force. It is another object of the invention to provide such a switch which has fewer parts than conventional switches and which can be more economically manufactured. Other objects, features and methods will be in part pointed out hereinafter.

DISCLOSURE OF THE INVENTION

Briefly, in accordance with the invention, a relatively inflexible movable contact arm is mounted on a first of two plate members which extend in parallel directions into a switch cavity and is adapted to move into and out of engagement with a stationary contact mounted on the second plate member. A low spring rate spring system, for example in the order of two pounds per inch, urges the movable contact arm toward the stationary contact. In one embodiment, for example, the desired contact force in the order of one to two ounces is obtained by displacing a portion of a flat spring attached to a face of one plate member in a direction away from the second plate member. Other embodiments employ a spring clip and pivotably mount the inflexible movable contact arm on a free distal portion of the first plate member with the spring clip attached at one point to the movable contact member on the side of the first plate member removed from the second plate member and attached at another point to the first plate member. In another embodiment, the movable arm portion and the spring portion are integrally formed with the spring portion mounted on the first plate member and so formed that the spring portion includes a part thereof extending away from the second plate member. In all of the embodiments the housing is symmetrically formed as a cylindrical cup with two slots in the bottom wall for receiving respective plate members which are securely fastened in the housing either by staking the terminals to the housing or by forming the plate members with a plurality of protrusions extending from an end face and abutting a major surface of a terminal blade with the end face with the protrusions extending through apertures in the terminal blade. The protrusions are then headed over to achieve a solid metal to metal connection. The open end of the housing is formed with a plurality of plateaus raised from a ledge which interfit with a thermally conductive cap. A motion transfer sheet of flexible resinous film having tab portions projecting from its periphery is received on the ledge with the tabs disposed between the plateaus and a snap-acting, thermally responsive disc is disposed between the cap and the resinous sheet which is formed so that the disc is maintained in optimum heat transfer relation with the cap. The spring clip can be inserted conveniently into the switch and merely by pushing it with or without a special tool clamped into position.

BRIEF DESCRIPTION OF THE DRAWINGS

The details of the invention will be described in connection with the accompanying drawings in which:

FIG. 15 is a partial section taken on lines 15—15 of FIG. 5 showing one techniques for fixing the plate members in the housing while

BEST MODES FOR CARRYING OUT THE INVENTION

Figure 1A:
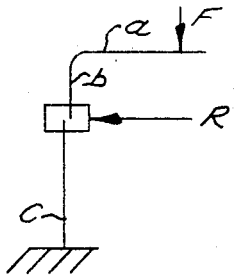
FIGS. 1*a* and 1*b* are schematic diagrams showing a movable contact arm and biasing means in conjunction with mathematical development of relevant forces and spring rates.
Figure 2:
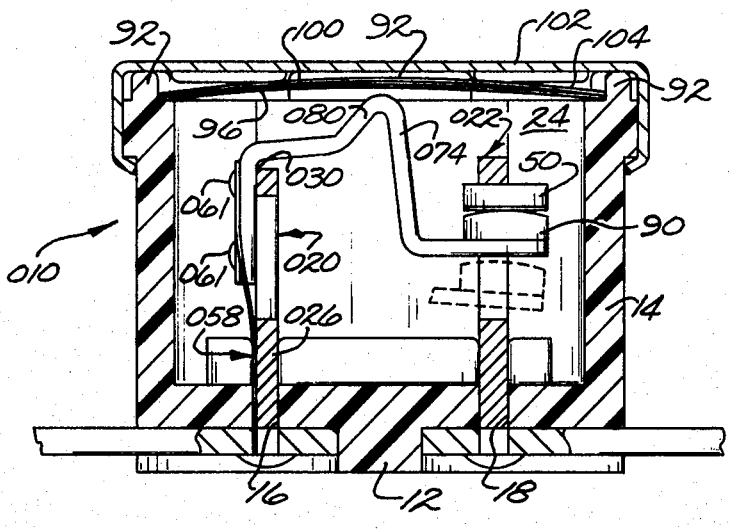
FIG. 2 is a cross-sectional elevational view of a first embodiment according to the invention.
Figure 3:
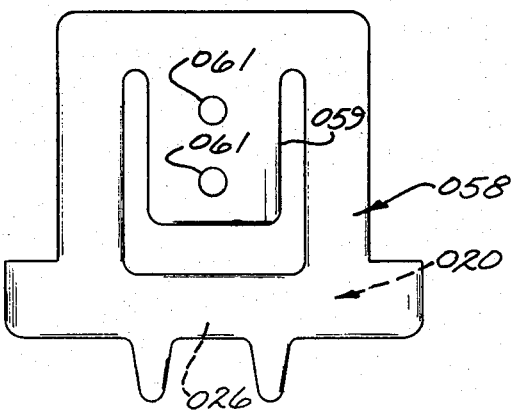
FIG. 3 is a side elevational view of the spring and first plate member used in the FIG. 2 device.

With reference to FIG. 1*a*, expressions for forces and spring rates can be derived as follows, particularly as applied to the embodiment shown in FIGS. 2 and 3 described infra.

R=Reaction Force
F=Contact Force
a,b,c=lengths of members
x,y,z=integration variables
E=Young's Modulus
M=Moment
I=Moment of Inertia
for a deflection at F $$\delta F = \frac{1}{EI} \int_I \frac{M\partial M}{\partial F}\, dl$$

Assuming clockwise moments as positive it can be shown that:

$$\delta_F = \frac{1}{EI_a} \int_o^a xFxdx + \int \frac{1}{EI_b} \int_o^b Fa\, dy + \frac{1}{EI_c} \int_o^c (Fa - Rz)adz$$

For $I_a$ and $I_b >> I_c$ the first two terms can be dropped and only the third term is needed, therefore:

$$\delta_F = 1/EI[Fa^2C - Rac^2/2]$$

For the spring rate $\partial F/\partial\delta_f = K = EI_c/a^2c$

For a straight cantilever member of length l similar to a and c:

$$K = 3(EI/l^3)3$$

Figure 1B:
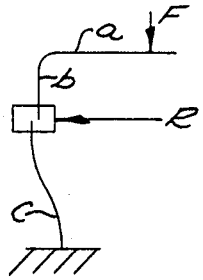

Thus for similar lengths the spring rate for the FIG. 1*a* model has been reduced by a factor of 3. In devices made in accordance with the following described embodiments with selected lengths for members a and c, a spring rate of approximately two pounds per inch was obtained as compared to the conventional spring rate in excess of ten pounds per inch in prior art devices. In addition to employing a relatively low spring rate, the desired level of contact force is generated by the reaction R by displacing member c to the left as seen in FIG. 1*b*. In the following embodiments the block at R does not exist as such, but is used for purposes of illustration and the mathematics involved. This displacement may be achieved in practice by any of several ways as by utilizing the thickness of the movable contact arm to which the spring is attached or by forming the spring into a particular configuration. For the above model the calculations were set up with both a and b members as flexible, however, in order to assure optimum contact attitudes, that is the orientation of the movable contact relative to the stationary contact, it is preferred to make members a and b inflexible as in assuming $I_a$ and $I_b >> I_c$.

Now with reference to FIGS. 2 and 3, a first embodiment will be described. Thermostatic switch 10 comprises a symmetrical, generally cylindrical cup-shaped housing having a bottom wall 12 and side wall 14 depending therefrom. The housing is composed of any suitable moldable, electrically insulative material such as Ryton, a registered trademark of Phillips Petroleum Co. for polyphenylene sulfide resins. Two parallel extending slots 16,18 extend through bottom wall 12 and provide access for first and second generally rectangular plate members 020,022 formed of a suitable electrically conductive material such as commercial bronze or cadmium copper. Plate members 020,022 extend into a switch cavity 24 formed within cylindrical wall 14. By way of example, the outer diameter of wall 14 may be in the order of one-half inch so the space within switch cavity 24 must be used very efficiently to make a device which is not only electrically effective, but also easy and inexpensive to assemble.

First plate member 020 is formed with a flat spring member 058 which is attached to plate member 020 along a major surface portion of the body 026 of plate member 020. Spring 058 is formed with a tongue portion 059 struck from the central portion of the spring so that it depends from top portion of the spring and is attached, as by rivets 061 to an inflexible movable contact arm 074 which is pivotably mounted on free distal surface 030 of plate member 020. The thickness of the movable arm on the side of the first plate member removed from the second plate member 022 displaces tongue portion 059 in order to obtain a selected contact force. This arrangement results in a reaction force of the movable arm against the first plate member which is large relative to the force exerted between movable contact 90 mounted in the free distal end of movable arm 074 and stationary contact 50 mounted on second plate member 022. For example in a device built in accordance with the invention the force of the movable arm against the first plate member is in the order of half a pound as compared to a contact force of approximately one ounce. That is, $$R = 3\delta_R EI_c/c^3$$

and $(3/c^3) > (1/ca^2)$ since $c < a$.

This large reaction force permits the use of a spring which need not be relied on to carry current since the current can pass from the plate member directly to the movable arm. Thus the spring can be formed of stainless steel or other high temperature material irrespective of its electrical conductivity thereby enabling use of the switch at temperatures of up to 450° F. or higher as opposed to prior art devices where a high conductivity material such as a copper alloy with limited strength at high temperatures was required for the current-carrying spring member.

An opening is preferably provided in plate member 020 to insure that pivoting movement of movable arm 074 is not inhibited by any interference with that portion of the plate member.

Motion is transferred to motion transfer portion 080 of movable arm 074 by means of a thermally responsive snap-acting disc 100 to which heat is conducted via cap 102. Upon being heated to a predetermined temperature, disc 100 will snap from one dished configuration to an oppositely formed dished configuration, ie., from upwardly facing convex to upwardly facing concave and transfer motion through a flexible, electrically insulative sheet 96 to force the movable contact from the solid line contacts engaged position to the dashed line contacts disengaged position. Further details on the particular constructional details of sheet 96 will be given below in connection with another embodiment of the invention.

As will be described in the next two embodiments, a low spring rate spring system can be used with the desired level of contact force by employing the same type of reaction force while using a spring clip. With particular reference to FIGS. 4–16, a switch 10 comprises a cylindrical cup shaped housing of the type shown in FIG. 2.

Figure 8:
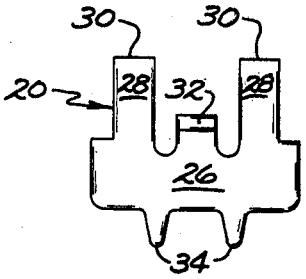
Figure 9:
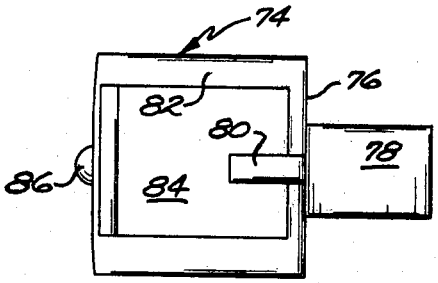
FIGS. 9–11 show different views of the movable contact arm employed in the FIG. 4 embodiment.
Figure 10:
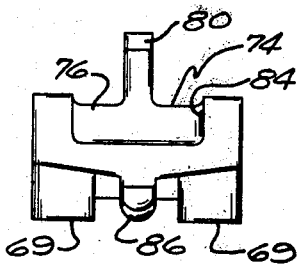
Figure 11:
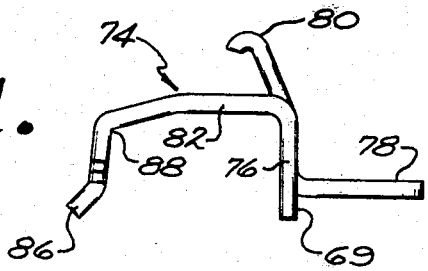

First plate member 20, as seen in FIG. 8, comprises a body portion 26 from which two fingers 28 extend upwardly terminating at a free distal end portion 30. A third finger 32 extends laterally and is used to provide a spring seat. At least one but preferably two projections, 34, project downwardly from body portion 26 and are received respectively in apertures 36 in a terminal blade 38 (see FIG. 15) and headed over to securely fix plate member 20 in the housing. By butting a major surface area of blade 38 squarely against the end face of plate member 20, a tight, solid connection is obtained without reliance on plastic or soldering. To further solidify the mount of plate member 20 within the housing and prevent any rocking movement or the like bosses 40 are formed in bottom wall 12 of the housing to add further support. Typically in prior art devices the terminals were affixed by placing metal members on opposite sides of the resinous housing and then riveting this joint to effect both electrical and mechanical connection. However, shrinking or cold flow of the resinous material tended to loosen the connection. In the present invention such shrinking of the housing material has no effect on the electrical connection and tends to enhance the mechanical support.

Second plate member 22 is formed with a body portion 42 of generally the same size as body portion 26 and is provided with projections 34 depending downwardly therefrom which are to be received in apertures 36 of terminal blade 44. Terminal blades 38,44 are shown projecting outwardly from the housing, however, it will be realized that they could be bent in any desired direction. Plate member 22 is formed with a window portion 46 defined by a frame 48. Attached to the bottom surface of the top portion of frame 48 so that it extends through window 46 is a stationary contact 50. Contact 50 is attached by any conventional method, as by welding, and is preferably formed with a cylindrically rounded outer mating surface as indicated at 52. Movable contact 90, mounted on movable arm 74 to be discussed below, has a similarly shaped outer mating surface but with its longitudinal axis disposed at right angles to that of surface 52 so that essentially a point contact engagement is achieved when the contacts are in the closed or contacts engaged position.

Figure 16:
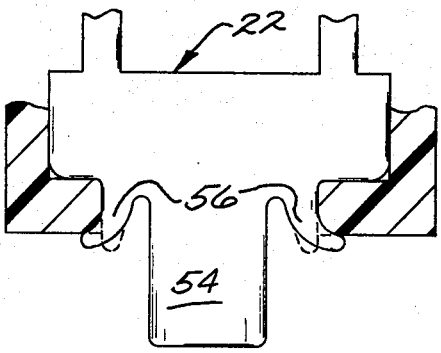
FIG. 16 is a similar view showing another technique.

In some instances it may be desired to make the terminal blade integral with the plate member. This is accomplished, as seen in FIG. 16, by providing terminal portion 54 and staking portion 56 on either side of portion 54. As shown by the dashed lines staking portions are bent outwardly after the plate member is put in place to securely fit the the plate member to the housing.

Figure 12:
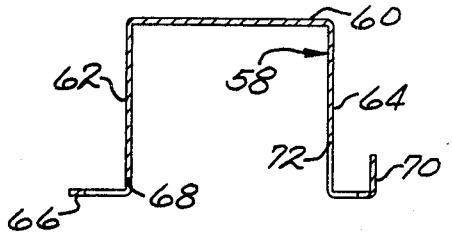
FIGS. 12–14 show different views of the spring used in the low spring rate system used in the FIG. 4 embodiment.
Figure 13:
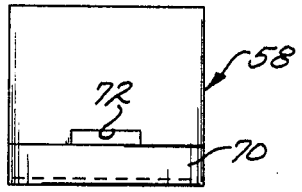
Figure 14:
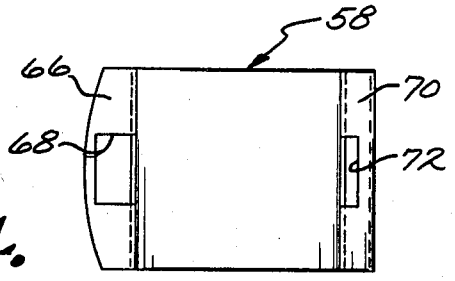

Spring clip 58, see in particular FIGS. 12–14, is formed in a generally U-shaped configuration having a bight portion 60 joining two depending legs 62,64. Leg 62 is formed with a tab 66 through what a slot 68 is formed and leg 64 is formed with a channel portion 70 with a slot 72 formed through a portion thereof.

A movable contact arm 74 formed of suitable electrically conductive material of a thickness that renders it relatively inflexible, such as that used for the plate members, has a body portion 76 from which a movable contact portion 78 laterally extends, and mounts thereon in any suitable manner movable electrical contact 90. Also extending from body portion 76 are motion transfer portion 80 and a frame portion 82. Frame 82 defines a window 84 and culminates in a downwardly extending tab 86. On the lower surface of frame 82 at the junction of that part of the frame which extends downwardly toward tab 86 with the remainder thereof a pivot surface 88 is formed.

Figure 14A:
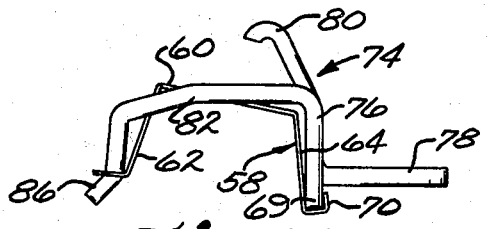
FIG. 14*a* is a front elevation showing the spring clip mounted on the movable contact arm prior to insertion into the switch cavity.
Figure 15:
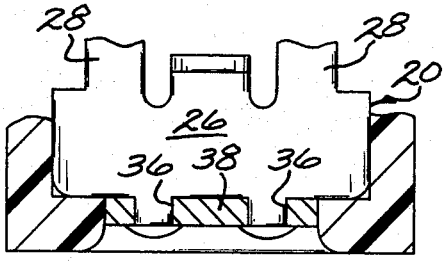

As seen in FIG. 14*a*, tab 86 of movable arm 74 is placed through slot 68 of spring clip 58 with the spring passing through window 84 and depending legs 69 of movable arm 74 received in channel portion 70. The movable arm 74 carrying spring clip 58 is then inserted into switch cavity 24 so that pivot surface 88 is placed on distal free end surface 30 of first plate member 20 and pushed downwardly. As the spring portion of the assembly is pushed down, slot 72 comes adjacent to the free distal end of finger 32 of plate member 20 and that end of spring clip 58 is transferred from legs 69 to finger 32.

Placing leg 62 of spring 58 on tab 86 of the movable contact member 74 which is pivoted on surface 30 of plate member 20 and leg 64 on finger 32 provides the displacement of the spring mentioned supra in order to obtain the desired contact force.

Figure 4:
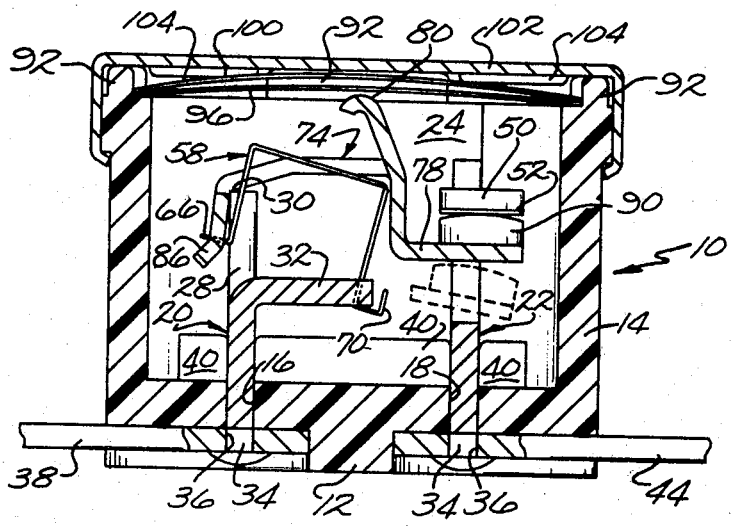
FIG. 4 is a cross-sectional elevational view of a second embodiment made in accordance with the invention.
Figure 5:
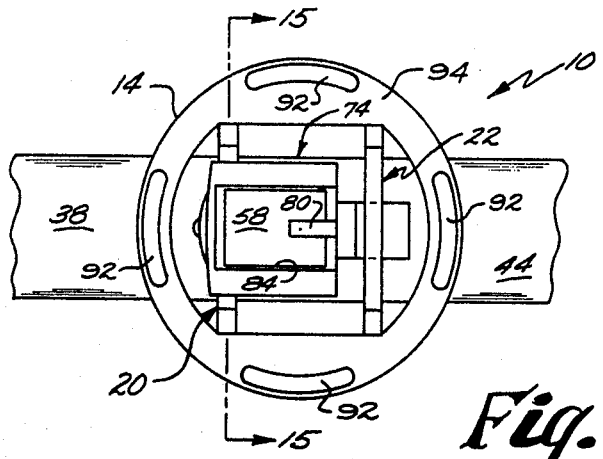
FIG. 5 is a top plan view of the FIG. 4 structure with the thermally conductive cap, snap-acting disc and motion transfer sheet removed to show the switch structure.
Figure 6:
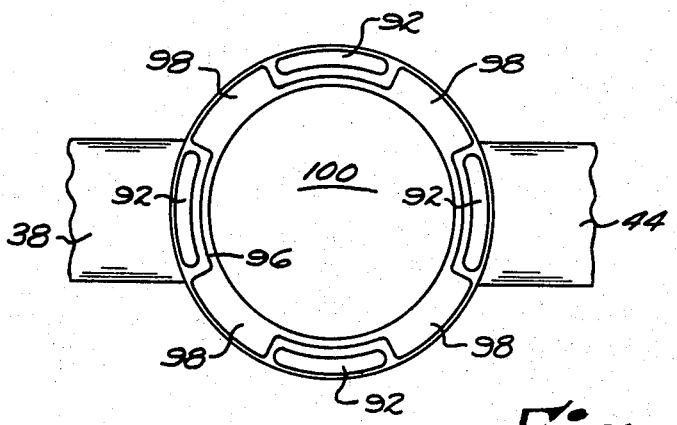
FIG. 6 is similar to FIG. 5, but including the snap-acting disc and motion transfer sheet.
Figure 6A:
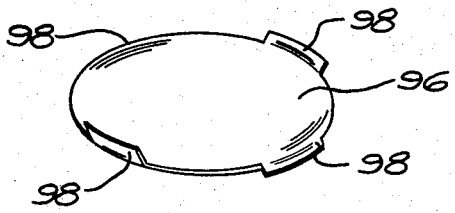
FIG. 6*a* is a perspective view of the motion transfer sheet.
Figure 7:
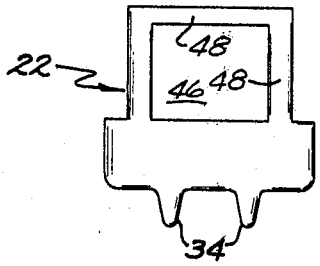
FIGS. 7 and 8 show first and second plate members used in the FIG. 4 embodiment.

As seen in FIGS. 4–6 a plurality of arcuately shaped plateaus 92 project upwardly from ledge 94 formed at the distal free end of cylindrical wall 14. With reference to FIG. 6, a sheet 96 of suitable flexible electrically insulative material, such as Kapton, a trademark of DuPont de Nemours Company for an aromatic thermoplastic polyimide film, having a plurality of tabs 98 is placed on ledge 94 with the tabs fitting between the spaced plateaus. A thermally responsive, snap-acting disc 100 is disposed on top of sheet 96 and a thermally conductive cap 102 formed of any suitable heat conducting material such as aluminum is received over and closes the open end of the housing maintaining sheet 96 and disc 100 in place. Preferably, sheet 96 is bent to form a spring system to maintain disc 100 in optimum heat transfer with cap 102. For example, as seen in FIG. 6*a*, tabs 98 are bent out of the plane of the sheet in order to urge disc 100 against cap 102 in optimum heat transfer relation therewith. Bending of the tabs up and down may be alternated in order to allow assembly with either face adjacent to the disc. Cap 102 is formed with a plurality of recessed portions 104 adapted to fit between the plateaus and spaced a selected distance from the ledge to form a seat for the snap-acting disc. This arrangement provides a crush-proof mount for the cap due to the solid backing of the plateaus at the same time that the disc is received in a seat which avoids any chance of being trapped in a skew orientation. Additionally, the height of the housing can be minimized by the extra distance of electrical insulation from the outer end portions of the plate members 20, 22 provided by the tab portions 98 of sheet 96 isolating the switching components from the cap 102.

Thus thermally conductive cap 102 conducts heat from the environment, transfers it to disc 100 which, upon reaching a selected temperature snaps from an upwardly facing convex configuration shown to the opposite upwardly facing concave configuration forcing motion transfer portion 80 of movable arm 74, through flexible sheet 96, downwardly against the urging of spring 58 to thereby separate contact 90 from stationary contact 50 as shown in the dashed line position.

Figure 20:
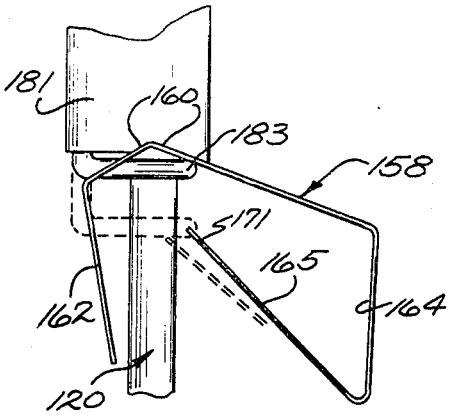
Figure 21:
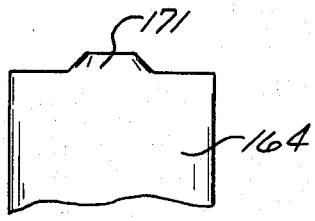
Figure 22:
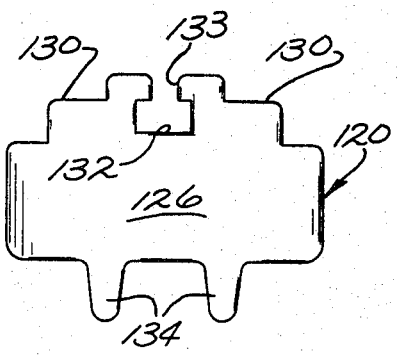
FIG. 22 is an elevational view of the first plate member used in the FIG. 17 embodiment.

Turning now to FIGS. 17–22 a second embodiment utilizing a spring clip is shown in which a housing is composed of material similar to that of the previous embodiments and has a cylindrical side wall 114 and a bottom wall 112 with parallel slots extending through the bottom wall. For approximately the same size occupied by the switch housing compared to the last described embodiment the FIG. 17 embodiment provides more electrical isolation between terminals 38,44 and a support means used to mount the switch to a surface to be monitored. Since switch cavity 124 is of a lower profile, plate members 120,122 are somewhat shorter in height compared to like members in the aforementioned embodiment. As seen in FIG. 22, first plate member 120 is formed with projections 134 depending downwardly from body portion 126 and has distal free end surface 130 formed on the upper part of body portion 126. Notch 132 is formed to provide a spring seat and has a slot 133 in communication therewith for a purpose to be explained below.

Second plate member 122 is formed essentially in the same configuration as plate member 22, but of a shorter height.

Movable arm 74 is of the same configuration as arm 74 and therefore will not be redescribed.

Figure 19:
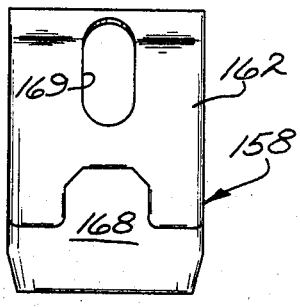
FIGS. 19–21 are views of the spring used in the FIG. 17 embodiment.

As seen in FIGS. 19–21, low spring rate clip 158 has a configuration somewhat similar to clip 58 in that it has a bight portion 160 joining legs 162 and 164, however, leg 164 is bent back on itself to form an end portion 165. A slot 168 is formed in leg 162 along with an aperture 169. A tab 171 is formed at distal free end portion 165.

Figure 17:
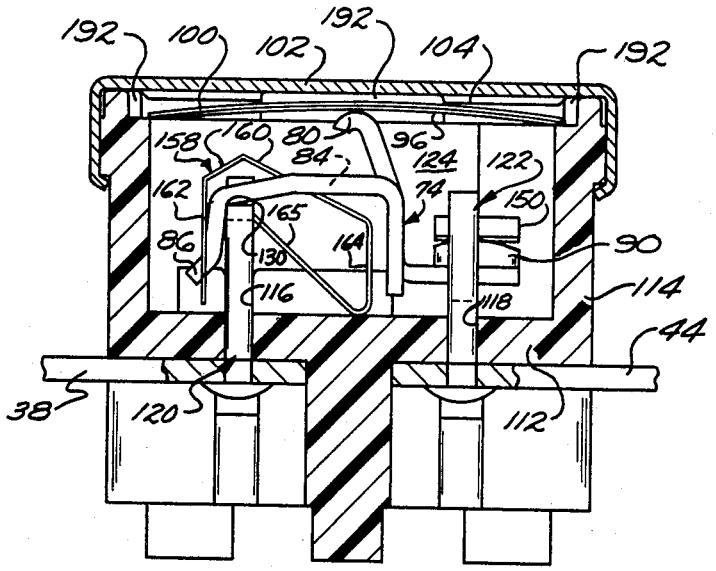
FIG. 17 is a view similar to FIG. 4 of another embodiment according to the invention.
Figure 18:
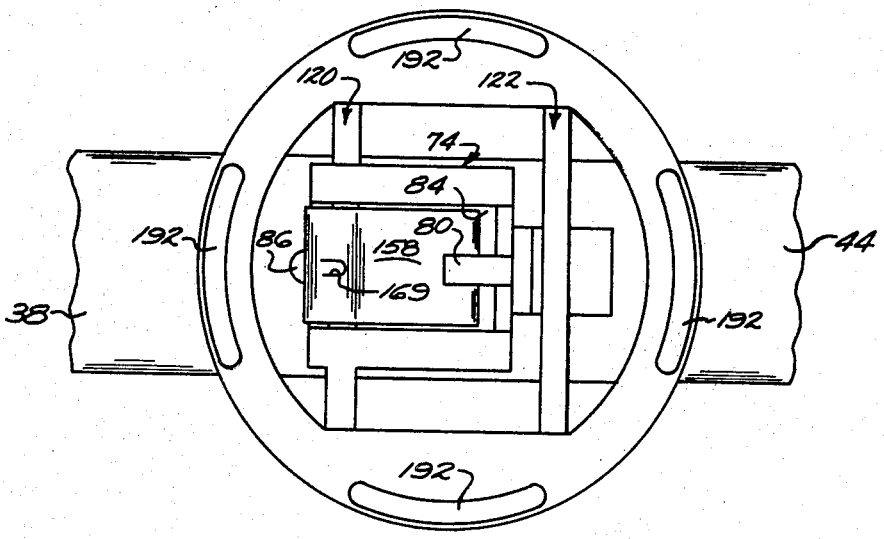
FIG. 18 is a top plan view of FIG. 17 with the thermally conductive cap, snap-acting disc and motion transfer sheet removed.

As seen in FIG. 20, a finger 183 is received through aperture 169 and captures bight 160 between it and surface portion of tool 181 configured in a shape complimentary to the relevant portion of clip 158. Finger 183 is spring biased (not shown) toward the body of tool 181 and is movable to the dashed line position. Clip 158 is picked up with tool 181 and is inserted into switch chamber 124 after movable arm 74 has already been put in place with movable contact 90 below stationary contact 150 and pivot surface 88 received on distal surface 130 of first plate member 120. FIG. 162 is slipped over the left hand portion of movable arm 74 (as seen in FIG. 17) with leg 164 received through window 84. Once leg 164 engages bottom wall 112 of the housing finger 183 is caused to move to the dashed line position (through slot 133 seen in FIG. 22) forcing tab 171 of leg 164 into spring seat slot 132 in first plate member 120. Finger 183 is then removed from aperture 169 with the spring clip in place.

Spring 158 transfers force through movable arm 74 causing the movable arm to pivot on surface 130 causing movable contact 90 to engage stationary contact 150 with the desired contact force. Thermally conductive cap 102 conducts heat from the environment, transfers it to disc 100 which, when reaching a selected temperature snaps from the upwardly facing convex configuration shown to the opposite upwardly facing concave configuration force, forcing motion transfer portion 80 of movable arm 74, through flexible sheet 96, downwardly against the bias of spring 158 to thereby separate contact 90 from stationary contact 150.

Figure 23:
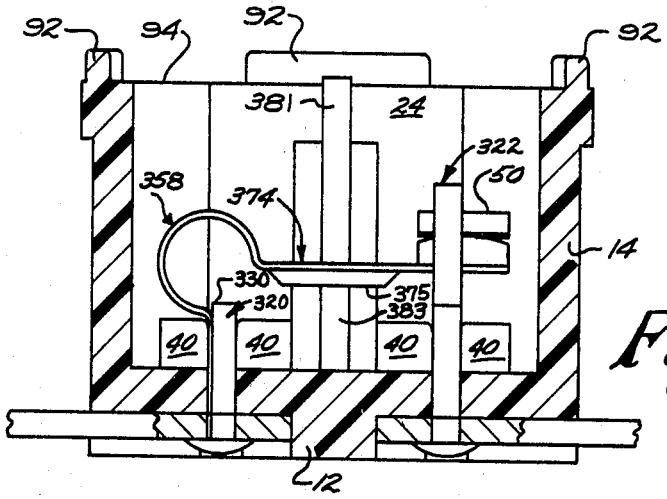
FIG. 23 is a view similar to FIGS. 2, 4, and 17 of another embodiment of the invention.
Figure 24:
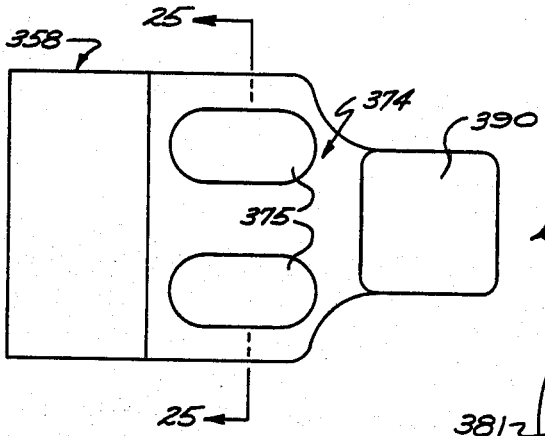
FIGS. 24 and 25 are views of the integral first plate member and integral movable contact arm and spring used in the FIG. 23 embodiment.
Figure 25:
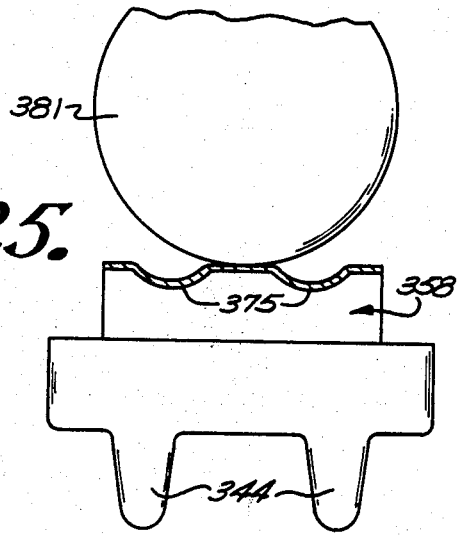

FIG. 23 shows yet another embodiment in which first plate member 320 extends into the switch cavity 24 only slightly beyond bottom wall 12. A flat plate portion of spring 358 formed of electrically conductive material such as beryllium copper is attached to member 320, as by welding. Spring 358 is formed into a circular bend of approximately 270° so that it is displaced on the side of plate member 320 removed from second plate member 22 and is integrally attached to the movable contact portion. Movable contact arm portion 374 is rendered relatively inflexible by forming several ribs 375 along its length. Contact 390 is mounted at the free distal end portion of movable contact arm portion 374 and is adapted to move into and out of engagement with stationary contact 50 mounted on second plate member 322. A supplemental motion transfer element 381 in the form of a circular disc of electrically insulative material is slidingly received in oppositely disposed, vertically extending grooves 383 formed in the side wall 14. Thus motion from disc 100 (not shown) is transferred through the flexible sheet 96 (not shown) and slidable member 381 to movable contact arm portion 374.

Figure 26:
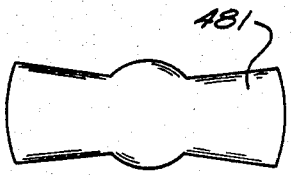
FIG. 26 is an elevational view of an alternate motion transfer element.

If desired FIG. 23 switching element can be used in a low profile housing such as that shown in FIG. 17. In that instance, a motion transfer member 481 shown in FIG. 26 can be employed. The curved surfaces received in the grooves of the side wall of the housing form a portion of a circle thereby allowing some rocking adjustment without any danger of jamming in the grooves. Also the curved surfaces in the central part of member 481 form a part of a circle so that the transfer of motion from the disc to the movable arm will be uniform no matter what the angular orientation of member 481 within the housing.

In all of the described embodiments a relatively low spring rate spring system is used to urge a relatively inflexible movable contact arm toward a stationary contact with a portion of the spring displaced to obtain a desired level of contact force. Due to the low spring rate system, the tolerance of the parts is not as critical as in prior art devices and calibration is obviated. In several embodiments the spring used to urge the movable contact arm toward the stationary contact need not be current carrying due to the large reaction force resulting from displacing the spring and thus enabling the provision of a switch operable in a higher temperature environment than prior art switches. Although normally closed switches have been shown and described, it is within the purview of the invention to employ the spring system with normally open devices as well.

In view of the above, it will be seen that the several objects of the invention are achieved and other advantageous results attained.

I claim:

1. An electrical switch comprising a housing forming a switch cavity therein, the housing having an open end, a thermally responsive snap-action disc disposed at the open end, a heat conductive cap attached to the housing over the disc in heat transfer relation therewith, a stationary electrical contact mounted in the switch cavity, movable electrical contact means mounted in the switch cavity and having a movable electrical contact adapted to move into and out of engagement with the stationary electrical contact, the movable electrical contact means includes a plate member having a distal end portion disposed in the switch cavity and mounting thereon a relatively inflexible, movable contact arm portion, and flat low spring rate biasing means urging the movable contact arm portion in a direction toward the stationary contact with a relatively low contact force, and motion transfer means mounted in the housing and adapted to transfer motion from the thermally responsive disc to the movable electrical contact means.

2. An electrical switch according to claim 1 in which the low spring rate biasing means and the movable electrical contact arm are integrally formed and the biasing means is mounted on the distal end portion of the plate member.

3. An electrical switch according to claim 2 in which a pair of oppositely disposed vertically extending grooves are formed in the side wall of the housing and a generally round electrically insulative disc is slidably disposed in the grooves and extends generally from the movable electrical contact arm to the open end of the housing.

4. An electrical switch according to claim 2 in which a pair of oppositely disposed vertically extending grooves are formed in the side wall of the housing and an electrically insulative element is slidably disposed in the grooves and extends generally from the movable electrical contact arm to the open end of the housing, the element having end faces and a top and bottom and having a width greater than its height, first curved surfaces formed at its end faces which fit into the grooves to allow one end face to move up or down relative to the other end face without binding in the grooves, and second curved surfaces on the top and bottom so that in the event that the end faces more relative to one another the spacing between the movable electrical contact arm and the open end of the housing does not vary.

5. An electrical switch comprising a housing forming a switch cavity therein, the housing having an open end, a thermally responsive snap-action disc disposed at the open end, a heat conductive cap attached to the housing over the disc in heat transfer relation therewith, a stationary electrical contact mounted in the switch cavity, movable electrical contact means mounted in the switch cavity and having a movable electrical contact adapted to move into and out of engagement with the stationary electrical contact, the movable electrical contact means includes a plate member having a distal end portion disposed in the switch cavity and mounting thereon a relatively inflexible, movable contact arm portion and low spring rate biasing means urging the movable contact arm portion in a direction toward the stationary contact, the biasing means includes a spring detachably connected to the plate member and the movable contact arm and motion transfer means mounted in the housing and adapted to transfer motion from the thermally responsive disc to the movable electrical contact means.

6. An electrical switch comprising a housing forming a switch cavity therein, the housing having an aperture extending into the switch cavity and an open end, a thermally responsive snap-action disc disposed at the open end, a heat conductive cap attached to the housing over the disc in heat transfer relation therewith, a stationary electrical contact mounted in the switch cavity, movable electrical contact means mounted in the switch cavity and having a movable electrical contact adapted to move into and out of engagement with the stationary electrical contact, the movable electrical contact means includes a plate member, extending through the aperture and having a distal end portion disposed in the switch cavity, the plate member having a spring seat, a relatively inflexible, movable contact arm portion and low spring rate biasing means urging the movable contact arm portion in a direction toward the stationary contact, the movable contact arm having a spring seat, the biasing means including a spring having first and second ends, the first end of the spring being connected to the plate member spring seat and the second end of the spring connected to the spring seat of the movable contact arm and motion transfer means mounted in the housing and adapted to transfer motion from the thermally responsive disc to the movable electrical contact means.

7. An electrical switch according to claim 4 in which the spring is detachably connected to the spring seat of the plate member and the movable contact arm.

8. An electrical switch according to claim 5 in which the spring is generally U-shaped in configuration.

9. An electrical switch according to claim 4 in which the movable contact arm has a pivot portion which rests on the distal end of the plate member.

10. An electrical switch according to claim 6 in which one end of the spring is bent back toward a bight portion of the U-shaped configuration.

11. An electrical switch comprising a housing forming a switch cavity therein, the housing having an open end, a thermally responsive snap-action disc disposed at the open end, a heat conductive cap attached to the housing over the disc in heat transfer relation therewith, a stationary electrical contact mounted in the switch cavity, movable electrical contact means mounted in the switch cavity and having a movable electrical contact adapted to move into and out of engagement with the stationary electrical contact, the movable electrical contact means includes a plate member having a distal end portion disposed in the switch cavity and mounting thereon a relatively inflexible, movable contact arm portion and low spring rate spring urging the movable contact arm portion in a direction toward the stationary contact, the spring being a generally flat sheet having the first end lying flat on the plate member and having the second end fixedly attached to the movable contact arm and motion transfer means mounted in the housing and adapted to transfer motion from the thermally responsive disc to the movable electrical contact means.

12. A condition responsive switch comprises an open-ended, cup-shaped housing formed of electrically insulative material, the housing having a bottom wall and a side wall extending from the bottom wall and terminating at a free distal end, the bottom and side wall defining a switch cavity therein, the bottom wall formed with first and second apertures extending therethrough, a first member formed of electrically conductive material having a first and second ends disposed in the first aperture and extending into the switch cavity and terminating at the first end, the member having a spring seating surface disposed intermediate its first and second ends, a movable contact member formed of electrically conductive material comprising a spring engaging portion, a contact portion and a pivot portion and motion transfer portion intermediate the spring engaging portion and the contact portion, the pivot portion disposed on the first end of the first member, a second member formed of electrically conductive material disposed in the second apertures and extending into the switch cavity, the second member mounting thereon a stationary contact, a spring member having first and second end portions, the first end portion engaged with the spring seating surface of the first member on a side of the first member facing the second member and the second end portion engaged with the spring engaging portion of the movable contact member disposed on the side of first member remote from the second member, the spring member biasing the contact portion of movable contact member toward the stationary contact with a relatively low contact force and biasing the movable contact member with a high force relative to the contact force, and condition responsive means operatively connected to the motion transfer portion of the movable contact member adapted upon occurrence of the condition to pivotably move the contact portion of the movable contact member away from the stationary contact.

13. A condition responsive electrical switch comprising a housing defining a switch cavity therein, the housing having a bottom wall with two apertures extending therethrough, a first electrically conductive, nonflexible plate member disposed in one of the two apertures and extending into the switch cavity, the plate member having a free distal end portion located within the switch cavity, an electrically conductive, nonflexible movable contact arm movably mounted on the free distal end portion of the plate member in electrical connection therewith, the movable contact arm having a movable contact portion and a motion transfer portion, stationary contact means mounted in the switch cavity, the stationary contact means including a second electrically conductive, nonflexible plate member disposed in the other of the two apertures and extending into the switch cavity, the movable contact arm movable toward and away from the stationary contact means, a flexible spring clip having first and second end portions, the first end portion operatively connected to the movable contact arm and the second end portion operatively connected to the first plate member and adpated to bias the movable contact arm toward the stationary contact means, condition responsive means mounted in the housing and adapted upon the occurrence of a condition to place a force on the motion transfer portion of the movable contact arm to move the arm away from the stationary contact means.

14. A condition responsive electrical switch according to claim 11 in which the housing includes a generally cylindrical side wall depending from the bottom wall and terminating at a distal free end, a ledge formed at the free distal end, a plurality of plateaus extending from the ledge and spaced around the periphery of the side wall, a thin, generally circular sheet of flexible resinous film having a plurality of outwardly extending tab portions disposed on the ledge with the tabs received between the plateaus, a thermally conductive cap received over the distal free end of the side wall, the cap formed with a plurality of detents, each detent received between adjacent plateaus and a thermally responsive disc movable from one configuration to another configuration upon the occurrence of a preselected temperature, the thermally responsive disc disposed between the resinous sheet and the cap, the motion transfer portion of the movable contact arm located adjacent the resinous film so that when the disc moves from one configuration to another its motion will be transferred to the movable contact arm through the resinous film.

15. A condition responsive electrical switch according to claim 11 in which the first plate member is formed with two generally parallel upstanding fingers and a third laterally extending finger, the fingers each having a distal free end, the distal free end of the two upstanding fingers forming the distal end portion of the plate member mounting the movable contact arm, the distal free end of the third finger being in engagement with the second end portion of the spring clip.

16. A condition responsive electrical switch according to claim 11 in which the second plate member is formed with a window defined by top, side and bottom margins, and an electrical contact is fixed to the top margin such that the contact is disposed in the window, the contact portion of the movable contact arm extends through the window.

17. A condition responsive electrical switch according to claim 14 in which the movable contact arm has a body portion including pivot seat, the pivot seat disposed on the distal free end of the fingers of the first plate member.

18. An electrical switch comprising a housing defining a switch cavity therein, the housing having a bottom wall with two apertures extending therethrough, a first electrically conductive metallic, plate member disposed in one of the two apertures and extending into the switch cavity, an electrically conductive movable contact arm movably mounted on and electrically connected to the plate member within the switch cavity, a second electrically conductive metallic, plate member disposed in the other of the two apertures and extending into the switch cavity, the movable contact arm movable into and out of electrical connection with the second plate member, the first and second plate members each formed with a flat end face with projections extending therefrom, two metallic blade terminals each having opposed major surfaces and having apertures extending between the opposed major surfaces, a blade terminal disposed on each end face with the projections extending through respective apertures, the projections headed over to securely lock with a metal to metal connection the terminals and plate members to the housing with no supplemental material needed for the mechanical and electrical connection between the terminals and the plate members.

19. An electrical switch comprising a housing defining a switch cavity therein, the housing having a bottom wall and a generally cylindrical side wall depending from the bottom wall and terminating at a distal free end, movable and stationary contacts disposed in the switch cavity, a movable contact arm mounting the movable contact and adapted to move the movable contact into and out of engagement with the stationary contact, a ledge formed at the free distal end of the side wall, a plurality of plateaus extending from the ledge and spaced around the periphery of the side wall, a thin, generally circular sheet of flexible resinous film having a plurality of outwardly extending tab portions disposed on the ledge with the tabs received between the plateaus, a thermally conductive cap received over the distal free end of the side wall and a thermally responsive disc movable from one configuration to another configuration upon the occurrence of a preselected temperature disposed between the resinous sheet and the cap, a portion of the movable contact arm located adjacent the resinous film so that when the disc moves from one configuration to another its motion will be transferred to the movable contact arm through the resinous film.

20. An electrical switch according to claim 19 in which the thermally conductive cap is formed with a plurality of detents and each detent is received between adjacent plateaus.

21. An electrical switch according to claim 19 in which the resinous sheet is an aromatic thermoplastic polyimide.

22. An electrical switch comprising a housing forming a switch cavity therein, the housing having an open end, a condition responsive snap-action disc disposed at the open end, a stationary electrical contact mounted in the switch cavity, a plate member extending into the switch cavity having a distal end forming a pivot having a pivot axis, a relatively inflexible movable electrical contact arm having first and second ends and a pivot seat therebetween, a movable contact mounted at the first end, the movable electrical contact arm disposed on top of the plate member with the pivot seat received on the pivot and with the movable contact adapted to move into and out of engagement with the stationary contact, a flat, low spring rate spring having first and second ends, the first end of the spring attached to the second end of the movable contact arm on a side of the pivot axis removed from the stationary contact, the second end of the spring reacting on the side of the pivot axis facing the stationary contact whereby a selected low contact force is obtained between the movable and stationary contact and a relatively larger force is obtained between the movable contact arm and the plate member, and motion transfer means mounted in the housing and adapted to transfer motion from the condition responsive disc to the movable electrical contact.

23. An electrical switch according to claim 22 in which the low spring rate spring is generally U-shaped.

24. An electrical switch according to claim 23 in which the plate member has a finger extending toward the stationary contact and the U-shaped spring has a slot in one of its legs which receives the finger of the plate member.

25. An electrical switch comprising a housing forming a switch cavity therein, the housing having an open end, a condition responsive snap-action disc disposed at the open end, a stationary electrical contact mounted in the switch cavity, a plate member having a relatively flat surface extending into the switch cavity;

a relatively inflexible movable contact arm having first and second ends, a movable electrical contact mounted at the first end, a flat, low spring rate spring having first and second opposed major surfaces having a portion of the first major surface attached to the flat surface of the plate member, the flat spring extending from the plate in a direction away from the stationary contact and being bent back toward the stationary contact, the flat spring being integrally attached to the second end of the movable contact arm, and motion transfer means mounted in the housing and adapted to transfer motion from the condition responsive disc to the movable electrical contact.

26. An electrical switch comprising a housing forming a switch cavity therein, the housing having an open end, a condition responsive snap-action disc diposed at the open end, a stationary electrical contact mounted in the switch cavity, a plate member having a relatively flat surface extending into the chamber, the flat surface facing away from the stationary contact, the plate member having a distal end forming a pivot having a pivot axis, a relatively inflexible movable contact arm having first and second ends and a pivot seat therebetween, a movable electrical contact mounted at the first end of the contact arm, the contact arm disposed on top of the plate with the pivot seat received on the pivot and with the movable contact adapted to move into and out of engagement with the stationary contact, a flat, low spring rate spring having first and second opposed major surfaces having a portion of the first major surface attached to the flat surface of the plate and having another portion of the said first major surface attached to the second end of the contact arm causing displacement of at least a portion of the spring in a direction away from the stationary contact to obtain a selected low contact force between the movable and stationary contacts and a relatively larger force between the contacts and the plate member, and motion transfer means mounted in the housing and adapted to transfer motion from the condition responsive disc to the movable electrical contact.

* * * * *